US006371484B1

(12) United States Patent
Yuan

(10) Patent No.: US 6,371,484 B1
(45) Date of Patent: Apr. 16, 2002

(54) CASINO CARD GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 0 days.

(21) Appl. No.: 09/580,356

(22) Filed: May 25, 2000

Related U.S. Application Data

(63) Continuation-in-part of application No. 09/123,250, filed on Jul. 27, 1998, now abandoned.

(51) Int. Cl.[7] ..... A63F 1/00
(52) U.S. Cl. ..... 273/292; 273/274
(58) Field of Search ..... 273/274, 292, 273/309

(56) References Cited

U.S. PATENT DOCUMENTS 5,257,810 A 11/1993 Schorr et al.
5,362,064 A 11/1994 Lofink et al.
5,377,993 A * 1/1995 Josephs
5,685,774 A 11/1997 Webb
5,743,560 A 4/1998 Sklad et al.
5,810,663 A * 9/1998 Bochichio et al.
5,820,128 A 10/1998 Brunelle
5,851,011 A 12/1998 Lott
5,863,042 A * 1/1999 Lo
5,873,571 A * 2/1999 Vaisman et al.
5,876,283 A 3/1999 Parra et al.
5,988,643 A * 11/1999 Awada
6,065,753 A * 5/2000 Morosky
6,270,078 B1 * 8/2001 Leone et al.
6,279,910 B1 * 8/2001 de Keller

* cited by examiner

*Primary Examiner*—William M. Pierce
(74) *Attorney, Agent, or Firm*—Robert Ryan Morishita Anderson & Morishita

(57) ABSTRACT

A casino card game between a casino and at least one player using at least one deck of fifty-two cards begins with the player placing a wager on either a first hand or a second hand. A dealer deals three cards to a first hand and three cards to a second hand. If either hand has a predetermined three-card combination, optionally a three of a kind, the first hand is compared to the second hand. The winning hand is the hand with the higher ranking three-card combination. If both hands have three-card combinations of equal rank, a push is declared and the player's wagers are returned. If neither hand has the predetermined three-card combination, the hands are into a two-card component hand and a single-card component hand. The component hands are compared. A push occurs when the first two-card hand is equal in rank to the second two-card hand and the first single-card hand is equal in rank to the second single-card hand or if one component hand of the first hand outranks the corresponding component hand of the second hand and the other component hand of the second hand outranks the corresponding component hand of the first hand. Otherwise, the winning hand is the hand with one component hand outranking the corresponding component hand of the other hand and the remaining component hand outranking or tying the corresponding component hand of the other hand. Players wagering on the winning hand are rewarded.

4 Claims, 5 Drawing Sheets

CASINO CARD GAME

RELATED APPLICATION DATA

The present application is a continuation-in-part of application Ser. No. 09/123,250 filed Jul. 27, 1998 by applicant herein now abandoned.

FIELD OF THE INVENTION

The present invention relates to casino card games. Specifically, the present invention is a card game in which a player wagers on one of two hands and is rewarded if, upon comparison, the player has wagered on the higher ranking hand.

BACKGROUND OF THE INVENTION

Card games such as Pai Gow Poker and Baccarat are well known forms of casino-type games. Specifically, these games are attractive to players because these games give the player a reasonable chance of winning their wager. Moreover, these games provide the casinos with a reasonable return for hosting the game.

Baccarat is a live table game that uses a standard deck of fifty-two playing cards. The object of the game of Baccarat is for the bettor to successfully wager on whether the Bank's hand or the Player's hand is going to win. The bettor receives even money for his wager if he selects the winning hand and loses his wager if he selects the losing hand. Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten. The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero. Whichever of the Bank hand or the Player hand is closest to a total of nine is the winner.

Depending on the point total of the initial Player's hand and the initial Dealer's hand, one more card may be dealt to either the Player's hand, the Dealer's hand or both. The rules for determining whether a third card is dealt are fixed; that is, there is no discretion for either the Player's hand or the Dealer's hand on whether a third card is dealt.

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Bank hand two card point total: | Bank hand DRAWS when the Player's hand third card is: | Bank hand STANDS when the Player's hand third card is: |
|---|---|---|
| 0, 1, or 2 | Bank always draws | |
| 3 | 0,1,2,3,4,5,6,7 or 9 | 8 |
| 4 | 2,3,4,5,6 or 7 | 0,1,8 or 9 |
| 5 | 4,5,6 or 7 | 0,1,2,3,8 or 9 |
| 6 | 6 or 7 | 0,1,2,3,4,5,8 or 9 |
| 7 | | Bank always stands |

At the end of each hand, winning wagers are paid and losing wagers are collected by the house. Any commission due to the house is marked in commission boxes in the center of the table.

One drawback of Baccarat is that the draw rules are complicated. Moreover, Baccarat is an unfamiliar game to most bettors. Thus, some players are intimidated from playing.

In Pai Gow Poker, seven cards are dealt to the banker and the players. The banker and players arrange the cards into a five-card high hand and a two-card low hand. Each player compares his or her high hand to the banker's high hand and his or her low hand to the banker's low hand. The player wins if both hands outrank the corresponding banker's hands according to conventional poker rankings. If one of the player's hands outranks one of the banker's hands, and the other banker's hand ties or outranks the other player hand, the player and banker "push" and the player neither wins nor loses his wager. If both the banker's hands outrank or tie the player's hands, the player loses his or her wager.

It can be seen that Pai Gow Poker lacks complicated draw rules; the player uses the cards he or she is dealt. Also, the comparison of hands in Pai Gow Poker is still fairly complicated and can be difficult to apply unless the player is familiar with conventional Poker rankings.

Thus, it can be seen that there is a need in the art for a casino card game that is simpler than prior art casino card games yet provides the player with a reasonable chance of winning.

SUMMARY OF THE INVENTION

A casino card game between a casino and at least one player using at least one deck of fifty-two cards begins with the player placing a wager on either a first hand or a second hand. A dealer deals three cards to a first hand and three cards to a second hand. The first hand and second hand are examined. If either hand has a predetermined three-card combination, optionally a three of a kind, the first hand is compared to the second hand. The winning hand is the hand with the higher ranking three-card combination. If both hands have three-card combinations of equal rank, a push is declared and the player's wagers are returned.

If neither hand has the predetermined three-card combination, the hands are into a two-card component hand and a single-card component hand. The component hands of the first hand are compared to the corresponding component hands of the second hands. A push occurs when the first two-card hand is equal in rank to the second two-card hand and the first single-card hand is equal in rank to the second single-card hand or if one component hand of the first hand outranks the corresponding component hand of the second hand and the other component hand of the second hand outranks the corresponding component hand of the first hand. Otherwise, the winning hand is the hand with one component hand outranking the corresponding component hand of the other hand and the remaining component hand outranking or tying the corresponding component hand of the other hand. Players wagering on the winning hand are rewarded. Optionally, the casino retains a commission on all winning wagers.

In a second aspect of the present game, each player wagers on his or her own hand rather than communal hands. Play is otherwise as described above.

DESCRIPTION

Figure 1:
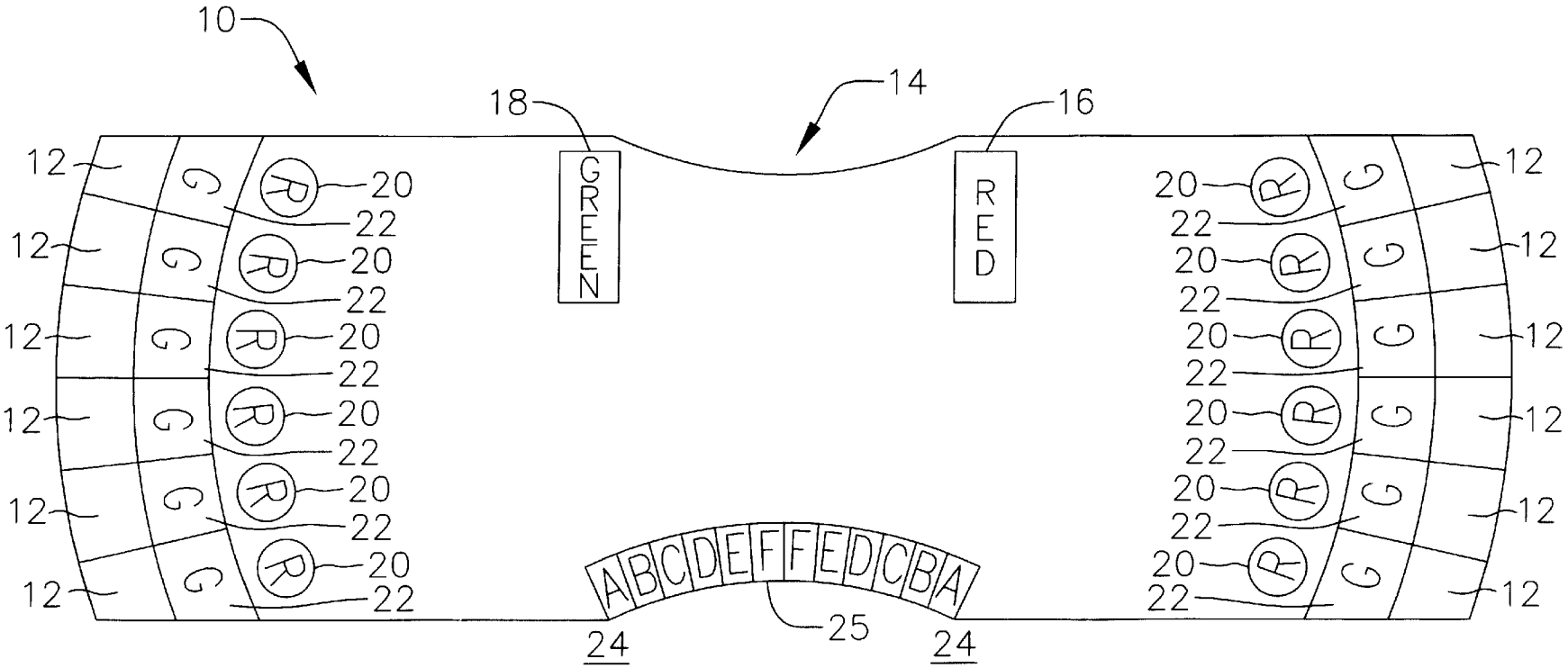
FIG. 1 is a top view of the table layout used for a game method according to an embodiment of the present invention.
Figure 2:
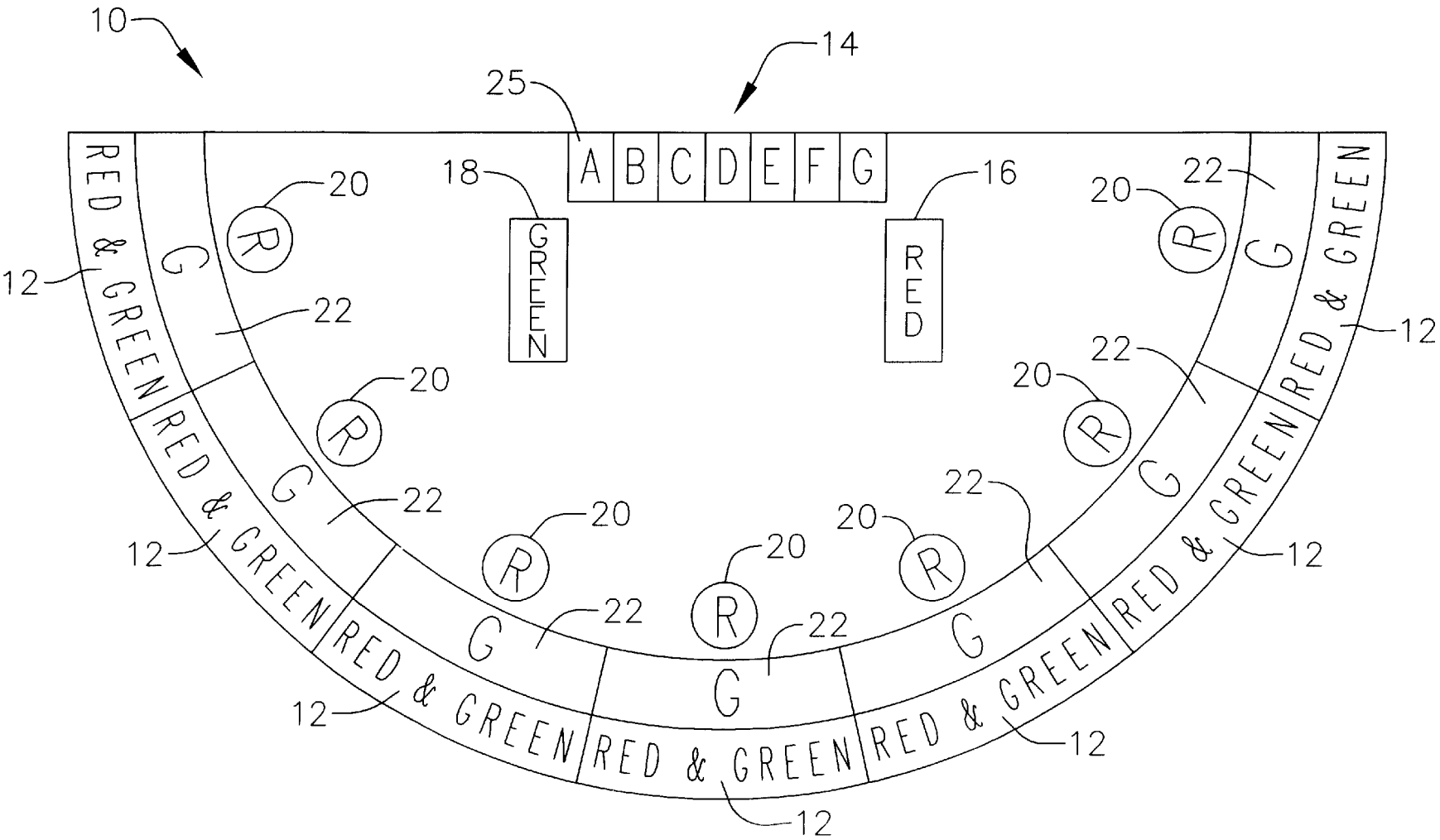
FIG. 2 is a top view of the table layout used for a game method according to an alternate embodiment of the present invention.

Reference is now made to the figures wherein like parts are referred to by like numerals throughout. With reference to FIGS. 1 and 2, the game of the present invention is played on a table layout 10 including player areas 12 and dealer areas 14. The layout 10 additionally includes areas for a first hand 16, referred to in the example below as the red hand 16, and a second hand 18, referred to in the example below as the green hand 18. The player areas 12 include a plurality of red hand betting areas 20 and a plurality of green hand betting areas 22. The layout 10 of FIG. 1 is has three areas for employees, a dealer area 14 for a dealer who deals cards and two croupier areas 24 for croupiers who pay and collect wagers. By contrast, the layout 10 of FIG. 2 has a single dealer area for a dealer who performs all tasks.

Figure 3:
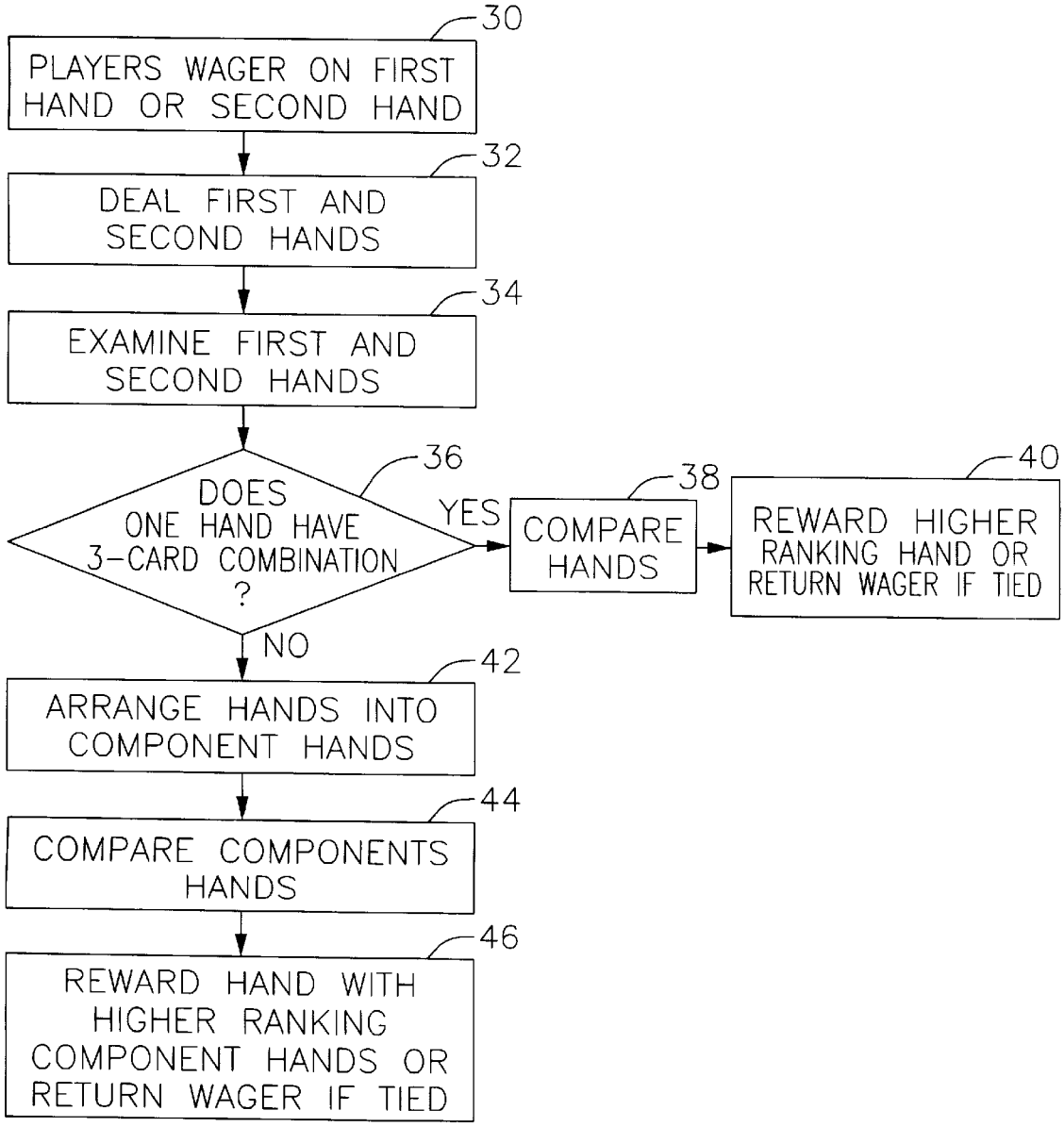
FIG. 3 is a flow chart of a game method according to an embodiment of the present invention.

With reference to FIG. 3, the game of the present invention requires at least one dealer and at least one player. The game of the present invention is played with a conventional deck of fifty-two playing cards. Optionally, a plurality of decks, such as seven, may be used in conjunction with a card shoe. After the cards are randomized, such as through shuffling and cutting, the players place their wagers 30. In a first aspect of the present game, shown in FIG. 3, each player wagers on communal hands, either the first hand, or red hand, or the second hand, or green hand. In a second aspect of the present game, shown in FIG. 4 and described hereinafter, each player is dealt 50 and wagers on 48 his or her own hand.

Referring to FIG. 3, in one embodiment of the present invention, the dealer deals 32 a three card red hand and a three card green hand and places them face up on the layout 10 at the red hand area and the green hand area. In an alternate embodiment, the dealer may deal three cards face down to the red hand area and three cards face down at the green hand area. The dealer may then build suspense by passing two cards from the green hand to the highest green hand bettor to expose before the dealer exposes the final card of the green hand. Alternatively or additionally, the dealer may do likewise with the red hand.

Once the green hand and red hand are exposed, the dealer examines 34 each hand to determine 36 whether either hand has a predetermined three-card combination, such as a three of a kind. If only one hand has the three-card combination, that hand is the winner 40. For example, if the red hand is 4♢ 4♡ 4♤ and the green hand is 3♡ 10♡ K♧, the red hand is the winner. All players wagering on the red hand are rewarded 40. Wagers placed on the green hand are collected. Optionally, the house may collect a commission, such as 5%, for all winning wagers. If both hands have the three-card combination, the hands are compared 38. The hand with the higher ranking combination is the winner 40. For example, if the red hand is 5♧ 5♡ 5♤ and the green hand is 8♧ 8♢ 8♡, the green hand is the winner. Wagers are resolved as above. If a multi-deck shoe is used, it is possible that both hands have equal ranking three-card combinations. If this occurs, a push is declared and wagers are neither collected nor rewarded 40. Optionally, the house may implement a rule that aces are the lowest ranked card or that aces are lower than deuces but higher than any other card (i.e. A♡ A♢ A♤ beats 7♢ 7♤ 7♡ but loses to 2♢ 2♤ 2♡).

If neither hand has the predetermined three-card combination, the dealer arranges 42 each hand into two component hands, a two-card high hand and a single-card low hand. The house may optionally institute a rule in which the high hand must outrank the low hand. Similarly, the house may optionally adopt house rules for how the dealer must arrange 42 the dealer's component hands. Specifically:

(1) Split pairs of aces, i.e. play one ace in each component hand, unless the third card is a King;

(2) Split pairs of Kings, i.e. play one King in each component hand, unless the third card is a Jack, Queen, or ace;

(3) Play all other pairs as the two-card component hand;

(4) If the hand has no pairs, play the second highest card as the single-card hand and the remaining cards as the two-card hand.

The red high hand is compared 44 to the green high hand and the red low hand is compared to the green low hand. While any ranking system could be used, for simplicity, the house may institute house rules that only two hands rank: a pair and card rank. In other words, the house may eliminate such hands as straight flush, flush, straight, and the like for the sake of simplicity and make a pair the highest ranking hand and the high card the next highest hand (like poker, if the highest ranking cards are tied, one looks to the next highest card, i.e. Q♡ 8♡ outranks Q♧ 3♧). In such an embodiment, for example, the red high hand of 5♢ 5♧ beats a green high hand of Q♤ K♤. Likewise, a red high hand of 4♡ 8♢ beats a green high hand of 3♧ 6♧. As with above, the house may optionally implement a rule that aces are the lowest ranked card or that aces are lower than deuces but higher than any other card (i.e. A♡ A♢ A♤ beats J♢ J♤ J♡ but loses to 2♢ 2♤ 2♡).

A hand is declared the winner 46 if the high hand and the low hand outrank the high hand and low hand of the other hand. For example, a green hand of 7♡7♤ and K♢ wins over a red hand of J♧ 8♢ and 9♡. Likewise, a hand is declared the winner if one of the component hands, either the high hand or the low hand, outrank the other hand's corresponding component hand and the remaining component hand ties the other hand's corresponding component hand. Thus, a red hand of K♡ 5♧ and 7♤ wins over a green hand of J♧ 2♢ and 7♡ or a green hand of K♢ 5♢ and 6♡. A push is declared 46 if both the high and low component hands tie the counterpart component hands or if one red component hand outranks the corresponding green component hand while the remaining green component hand outranks the remaining red component hand. For example, 4♣ 4♡ and 7♢ ties 4♢ 4♠ and 7♡. Likewise, 5♡ 5♠ and 9♣ ties K♠ 4♢ and 10♡.

Wagers are resolved by rewarding 46 players wagering on the winning hand. Optionally, the wagers are rewarded at even money. Losing wagers are collected. In the event of a push 46, wagers are returned to the players. In an optional embodiment, a commission is charged by the house for winning wagers. With reference to FIGS. 1 and 2, the commission owed by each player may be tracked at a commission area.

Figure 4:
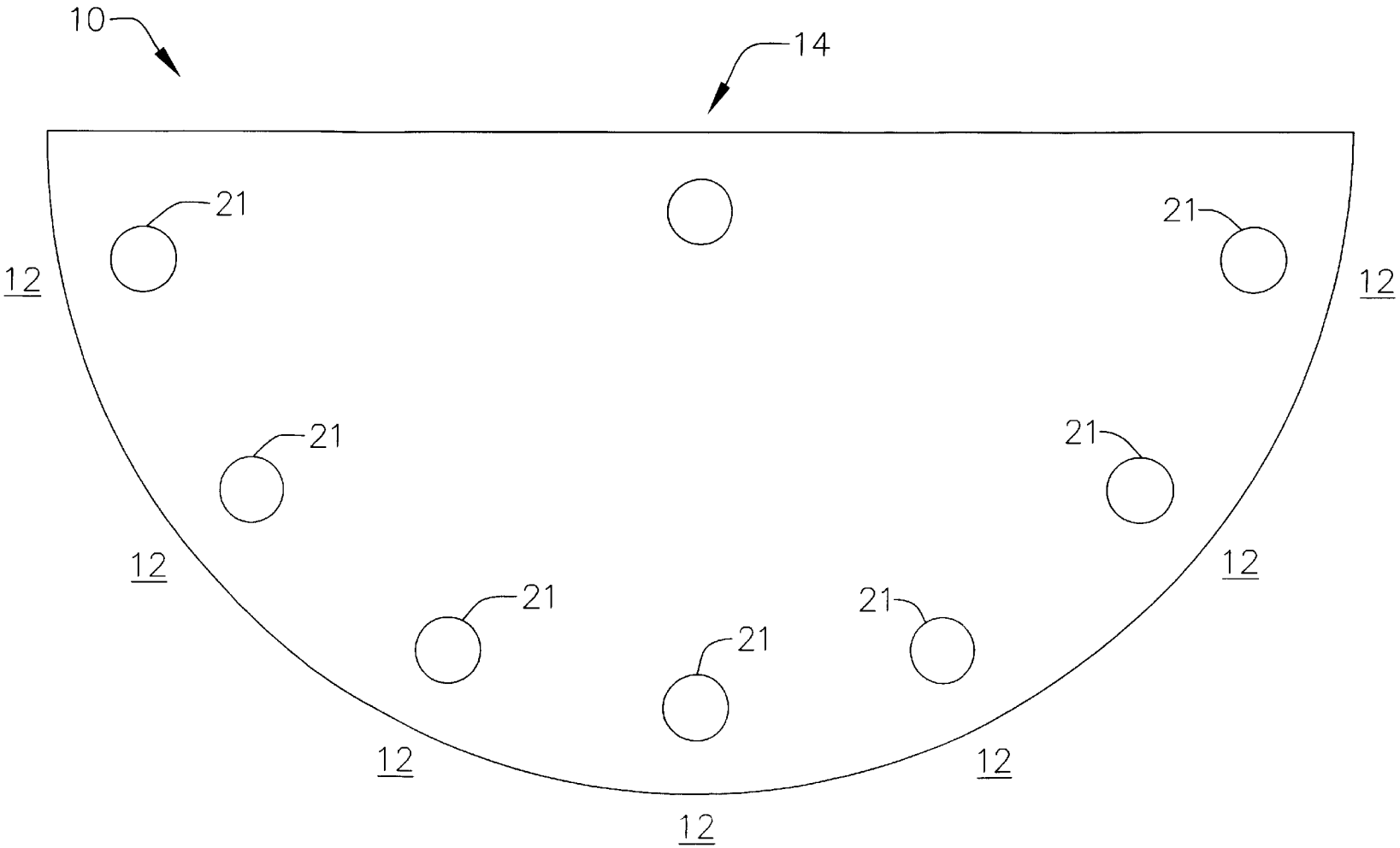
FIG. 4 is a top view of the table layout used for a game method according to an alternate embodiment of the present invention.
Figure 5:
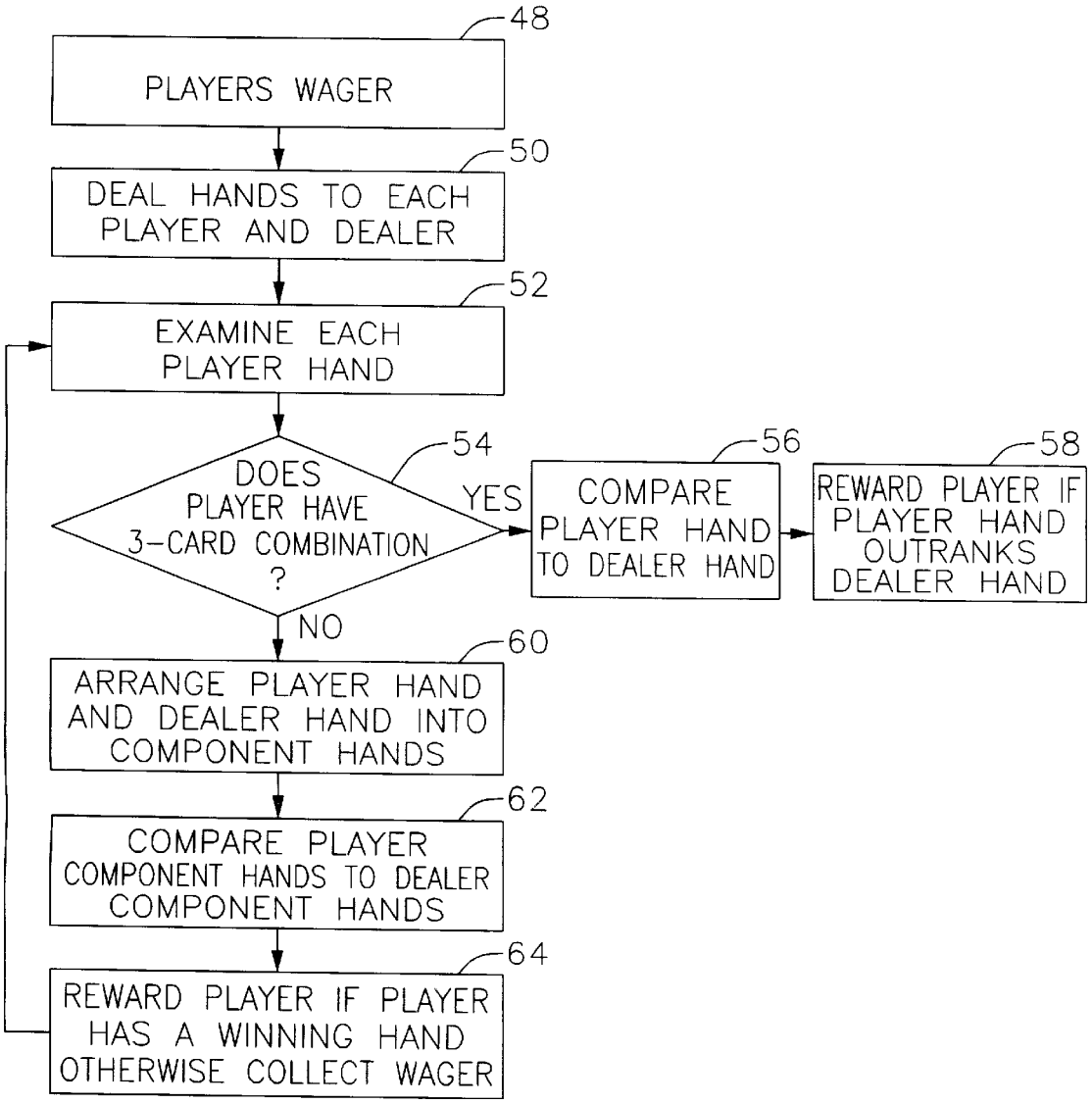
FIG. 5 is a flow chart of a game method according to an alternate embodiment of the present invention.

Referring to FIGS. 4 and 5, in a second aspect of the present invention, each player places a wager 48 at a player wagering area 21 on the table layout 10. The dealer deals three cards 50 to each wagering player and to the dealer at the player areas 12 and dealer area 14, respectively. In this aspect of the present invention, each player wagers on whether the player's hand will outrank the dealer's hand rather than on communal hands.

Each player hand is serially examined 52 to determine 54 whether the player hand has a predetermined three-card combination, such as a three of a kind. Any hand having the three-card combination is the winner 58 unless, comparing 56 the player hand to the dealer hand, the dealer has a three-card combination outranking the player hand. For example, if the player hand is 4♢ 4♡ 4♠ and the dealer hand is 3♡ 10♡ K♣, the player hand is the winner. Conversely, if the player hand is 4♢ 4♡ 4♠ and the dealer hand is 7♣ 7♢ 7♡ , the dealer hand wins. Wagers are paid 58 if the player has a winning hand or collected if the dealer has a winning hand. If a multi-deck shoe is used, it is possible that both hands have equal ranking three-card combinations. In the third aspect of the game, when this occurs, the player loses and wagers are collected. That is, players lose on ties when playing against the dealer. Optionally, the house may implement a rule that player's hands with three of a kind aces or Kings automatically win. Thus, a player hand K♢ K♡ K♠ wins even if the dealer has A♢ A♡ A♠. Likewise, the house may implement a house rule that aces are lower than deuces but higher than any other card (i.e. A♡ A♢ A♠ beats 7♢ 7♠ 7♡ but loses to 2♢ 2♠ 2♡). That is, three of a kind deuces may be the highest ranking three of a kind.

After resolving all player hands with three card combinations, the dealer arranges 60 the dealer hand into two component hands, a two-card high hand and a single-card low hand. Similarly, the remaining players each arrange 60 their hands into a two-card high hand and a single-card low hand. The house may optionally institute a rule in which the high hand must outrank the low hand. The dealer high hand is compared 62 to the each player high hand and the dealer low hand is compared to each player low hand. Again, any ranking system could be used. However, for simplicity, the ranking system that uses only pairs and card ranks as described above may optionally be used. As with above, the house may optionally implement a rule that aces are the lowest ranked card or that aces are lower than deuces but higher than any other card (i.e. A♡ A♢ A♠ beats 7♢ 7♠ 7♡ but loses to 2♢ 2♠ 2♡). Also, optionally, the dealer may win on ties. That is, if the player's high and low component hands tie 64 the dealer's counterpart component hands, the dealer wins.

A player hand is declared the winner if the player high hand and the player low hand outrank 64 the dealer high hand and dealer low hand. A winning player hand is rewarded 64, optionally at even money, without.

A push is declared if one player's component hand outranks the corresponding dealer's component hand while the remaining dealer's component hand outranks or ties the remaining player's component hand. In the event of a push, the player's wager is collected 64. Likewise, if both the dealer's component hands outrank the player's component hands, or if one of the dealer's component hands outranks the player's component hand and the remaining dealer's component hand ties the player's component hand, the player's wager is collected.

While certain embodiments of the present invention have been shown and described it is to be understood that the present invention is subject to many modifications and changes without departing from the spirit and scope of the claims presented herein.

I claim:

1. A method for playing a casino card game for at least one player, the game method using at least one deck of fifty-two cards, comprising:

the player placing a wager on either a first hand or a second hand;

a dealer dealing three cards to a first hand and three cards to a second hand;

examining the first hand and the second hand;

if either hand has a predetermined three-card combination, comparing the first hand to the second hand and declaring the winning hand to be the hand having the higher ranking three-card combination, otherwise declaring a push if the first and second hands have three-card combinations of equal rank;

if neither hand has the predetermined three-card combination, arranging each hand into a two-card component hand and a single-card component hand;

comparing the first two-card hand to the second two-card hand and the first single-card hand to the second single-card hand;

declaring a push and returning each player's wager if the first two-card hand is equal in rank to the second two-card hand and the first single-card hand is equal in rank to the second single-card hand or if one component hand of the first hand outranks the corresponding component hand of the second hand and the remaining component hand of the second hand outranks the corresponding component hand of the first hand;

otherwise, declaring the winning hand to be the hand having a component hand outranking the corresponding component hand of the other hand and a remaining component hand outranking or tying the corresponding hand of the other hand; and rewarding players wagering on the winning hand and collecting wagers from players wagering on the losing hand.

2. The method of claim 1 wherein the predetermined three-card combination is a three of a kind.

3. A method for playing a casino card game for at least one player, the game method using at least one deck of fifty-two cards, comprising:

the player placing a wager on either a first hand or a second hand;

a dealer dealing three cards to a first hand and three cards to a second hand;

examining the first hand and the second hand;

if either hand has three of a kind, comparing the first hand to the second hand and declaring the winning hand to be the hand having the higher ranking three of a kind, otherwise declaring a push if the first and second hands have three of a kinds of equal rank;

if neither hand has three of a kind, arranging each hand into a two-card component hand and a single-card component hand;

comparing the first two-card hand to the second two-card hand and the first single-card hand to the second single-card hand;

declaring a push and returning each player's wager if the first two-card hand is equal in rank to the second two-card hand and the first single-card hand is equal in rank to the second single-card hand or if one component hand of the first hand outranks the corresponding component hand of the second hand and the other component hand of the second hand outranks the corresponding component hand of the first hand;

otherwise, declaring the winning hand to be the hand having a component hand outranking the corresponding component hand of the other hand and a remaining component hand outranking or tying the corresponding hand of the other hand; and rewarding players wagering on the winning hand and collecting wagers from players wagering on the losing hand.

4. A method for playing a casino card game for at least one player, the game method using at least one deck of fifty-two cards, comprising:

the player placing a wager;

a dealer dealing a three-card hand to each player and to the dealer;

examining each player hand;

for every player hand having a predetermined three-card combination, comparing the player hand to the dealer hand and declaring the player hand to be a winning hand unless the dealer hand has a higher ranking three-card combination;

for every player hand lacking the predetermined three-card combination, arranging each player hand and dealer hand into a two-card component hand and a single-card component hand;

for each player, comparing the player's two-card hand to the dealer's two-card hand and the player's single-card hand to the dealer's single-card hand;

declaring a push and collecting the player's wager if one component hand of the player's hand outranks the corresponding component hand of the dealer's hand and the remaining component hand of the dealer's hand outranks the corresponding component hand of the player's hand;

declaring a player's hand to be a winning hand if one of the player's component hands outranks the corresponding dealer's component hand and the remaining player component hand outranks the corresponding dealer component hand; and rewarding each player having a winning hand and collecting wagers from players not having winning hands.

* * * * *